United States Patent [19]

Viselli

[11] Patent Number: 4,911,659

[45] Date of Patent: Mar. 27, 1990

[54] ELECTRICAL CONNECTOR AND A RETENTION BRACKET THEREFOR

[75] Inventor: Michael A. Viselli, Elizabethtown, Pa.

[73] Assignee: AMP Incorporated, Harrisburg, Pa.

[21] Appl. No.: 342,200

[22] Filed: Apr. 21, 1989

[51] Int. Cl.[4] ..... H01R 13/73

[52] U.S. Cl. ..... 439/570; 439/607; 439/564

[58] Field of Search ..... 439/108, 569–571, 439/573, 607–610, 564

[56] References Cited

U.S. PATENT DOCUMENTS

| | | | |
|---|---|---|---|
| 4,457,575 | 7/1984 | Davis et al. . | |
| 4,458,973 | 7/1984 | Hayes et al. | 439/347 |
| 4,572,602 | 2/1986 | Rupnik . | |
| 4,629,266 | 12/1986 | Viselli . | |
| 4,709,973 | 12/1987 | Waters et al. . | |
| 4,842,552 | 6/1989 | Frantz | 439/557 |

*Primary Examiner*—Gary F. Paumen

*Attorney, Agent, or Firm*—David L. Smith

[57] ABSTRACT

A one-piece, cast metal insert (40) has a base (42) from an edge of which upstands a flange (54). The base has a bore (48) therethrough for receiving a resilient locking metal clip (86) for securing the bracket (40) to a circuit board (CB) and for making contact with a ground conductor (GC) on the circuit board (CB). An internally screw threaded shank (60) projecting from the flange (54) has external retention ribs (68 and 70) for securing it in an opening (26) in a mounting ear (34) of a shielded electrical connector housing (2). The housing (2) with the bracket (40) assembled thereto can be mounted on the circuit board (CB) by means of a robot. The connector can then be secured to a panel (P) for example in a computer, by passing a screw (S) through the panel (P) to mesh with the screw thread (66) of the shank (60). When the screw (S) is tightened, the flange (54) is urged against part (38) of the metal shield (18) of the housing (2), which extends behind the mounting ear (24), so that the shield (18) is electrically connected firmly to the ground conductor (GC).

20 Claims, 7 Drawing Sheets

ELECTRICAL CONNECTOR AND A RETENTION BRACKET THEREFOR

FIELD OF THE INVENTION

This invention relates to a metal retention bracket for securing a shielded electrical connector housing to a circuit board to connect the shielding of the housing to a ground conductor on the board and for securing said housing to a mounting panel. The invention also relates to an electrical connector assembly incorporating such a bracket. The invention particularly, but not exclusively, concerns the grounding of the shields of Shielded Data Link (SDL) electrical connectors for use in the computer industry.

BACKGROUND OF THE INVENTION

There is disclosed in U.S. Pat. No. 4,709,973, a cast metal retention member for use in securing an electrical connector mounted on a circuit board, to a panel, for example a computer back panel. The retention member comprises a flange, from which extends a tubular shank for insertion into an opening in a mounting portion of the connector housing, the shank being internally screw threaded for meshing with a screw for securing the housing to the panel. The shank has external retention means in the form of peripherally extending, and axially extending, spaced ribs, which are configured not only to secure the shank in the opening against axial and rotary movement with respect to the housing, but also to ensure that the shank can be cold pressed into the opening without damage to the mounting portion of the housing, which may be thin walled. The retention member thus acts as a screwlock so that no loose nut is needed for securing the housing to the panel. For securing the housing to the circuit board, a mounting portion of the housing is provided with a bottom flange which is apertured so that it can be bolted to the circuit board. Since the housing, and thus the bottom flange, are of insulating material the bolt serves no electrical connecting function.

There is described in U.S. Pat. No. 4,842,552 a one piece, stamped and formed locking clip for insertion into aligned holes in a superposed plate and a circuit board to secure them together to allow the locking clip to be soldered to a ground conductor on the circuit board. The locking clip has a resilient and compliant first portion for reception in the hole in the plate, a second portion for reception in the hole in the circuit board and spring arms for engaging with the ground conductor.

Shielded Data Link connectors are disclosed in U.S. Pat. Nos. 4,457,575, 4,458,973, and 4,572,602. Such connectors are used, especially where a cathode ray tube and the keyboard of a computer need to be connected by means of shielded cable. A mating pair of such connectors comprises a shielded plug connector and a shielded receptacle connector, the latter usually being panel mounted.

SUMMARY OF THE INVENTION

The present invention is intended to provide a metal bracket for securing the housing of a shielded electrical connector to a circuit board by the use of a locking clip as described above, the bracket serving to electrically connect the connector shield to a ground conductor on the circuit board and to receive a screw for securing the housing, when mounted on the circuit board, to a panel.

The housing with the bracket assembled thereto and the locking clip assembled to the bracket, can conveniently be mounted on the circuit board by means of a robot. A metal bracket according to the present invention, which is preferably cast in one piece, for example from brass or zinc or zinc alloy, comprises a base plate having a through bore for receiving the metal locking clip, a flange upstanding from an edge of the base plate, and a tubular shank projecting from the flange normally thereof in a direction away from the base plate. The shank is internally screw threaded and is provided with external retention means for example in the form of spaced longitudinal and peripheral ribs. In order to mount the connector housing to a circuit board, the locking clip is inserted into the bore in the base plate, the shank is inserted into an opening in a mounting portion, usually a mounting ear, of the housing, being retained therein by said retention means, and the housing is then placed on the circuit board so that the locking clip enters a hole therein to engage the ground conductor and to secure the housing to said board. The locking clip is then soldered to the ground conductor and the tails of contacts in the housing soldered to other conductors on the board. Said mounting portion is embraced by the shield, so that when the bracket has been secured to the mounting portion, the flange of the bracket engages an end portion of the shield behind the mounting ear. At the site of use, a screw is passed through a hole in the panel to which the housing on the circuit board is to be mounted, and is screwed home into the shank of the bracket thereby drawing the flange thereof firmly against said shield end portion. In practice, the housing will have a mounting portion at each end, a bracket being, therefore, provided for each mounting portion.

Conveniently, the bracket is configured as an insert which is slideable onto the mounting portion, which is complementarily configured to this end. In this event, the aforementioned bottom flange of the mounting portion can be severely truncated with a consequent saving of the housing material. The flange of the bracket and the base plate thereof may be shaped to provide a recess for receiving the truncated flange of the mounting portion. The base plate may be formed with a lateral guideway for receiving a rib of the mounting portion.

According to one embodiment of the invention, the bottom flange of the mounting portion of the housing is dimensioned to extend beneath the base plate of the bracket. Said base plate as placed on the bottom flange and an eyelet is passed through a hole in said bottom flange and the bore in the base plate and is riveted to the base plate, after which the locking clip is inserted into the eyelet.

DETAILED DESCRIPTION OF THE INVENTION

Figure 1:
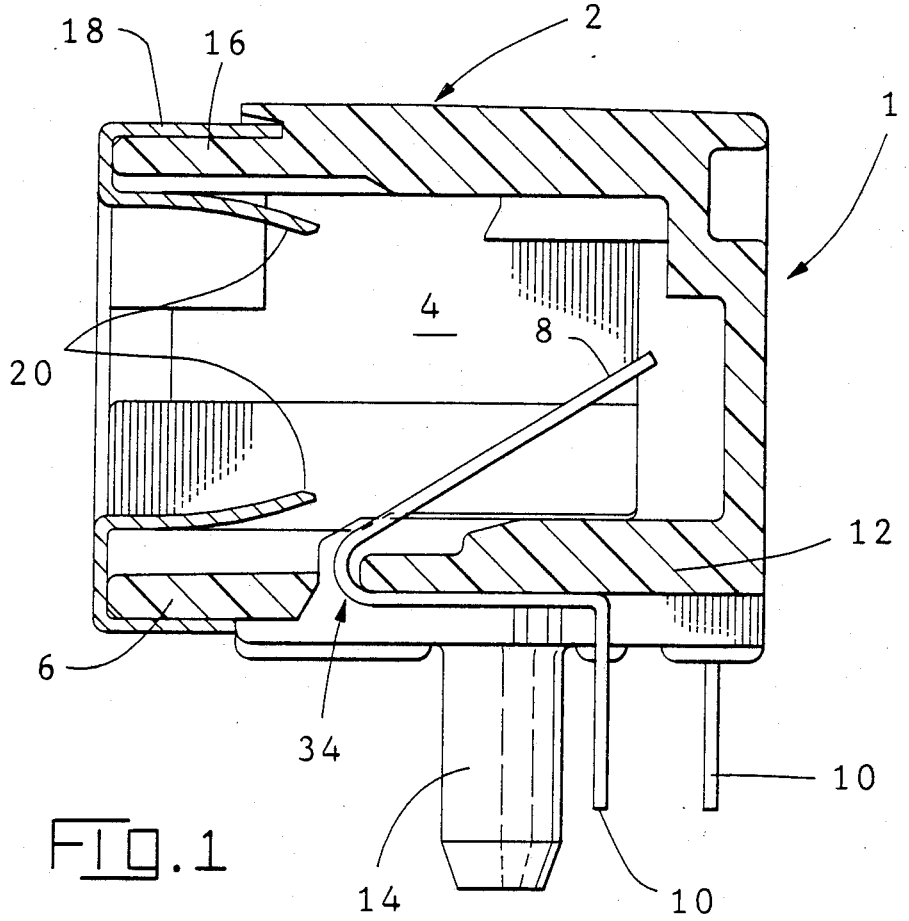
FIG. 1 is a cross sectional view of a Shielded Data Link electrical receptacle connector comprising an insulating housing, a metal shield, and electrical contacts in the housing.
Figure 3:
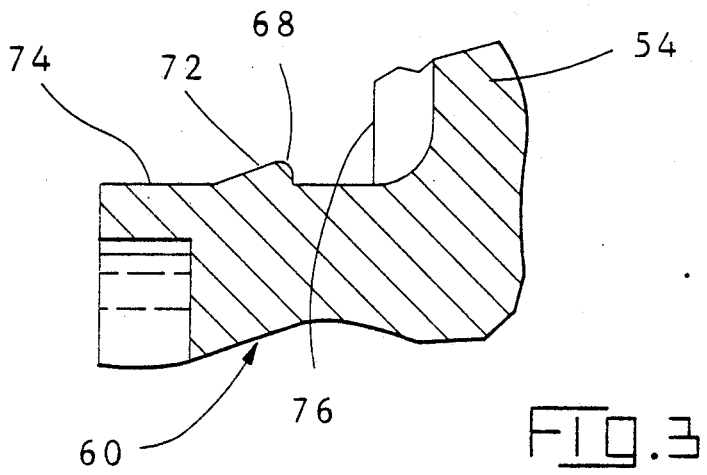
FIG. 3 is an enlarged, fragmentary sectional view taken on the lines 3—3 of FIG. 2.
Figure 2:
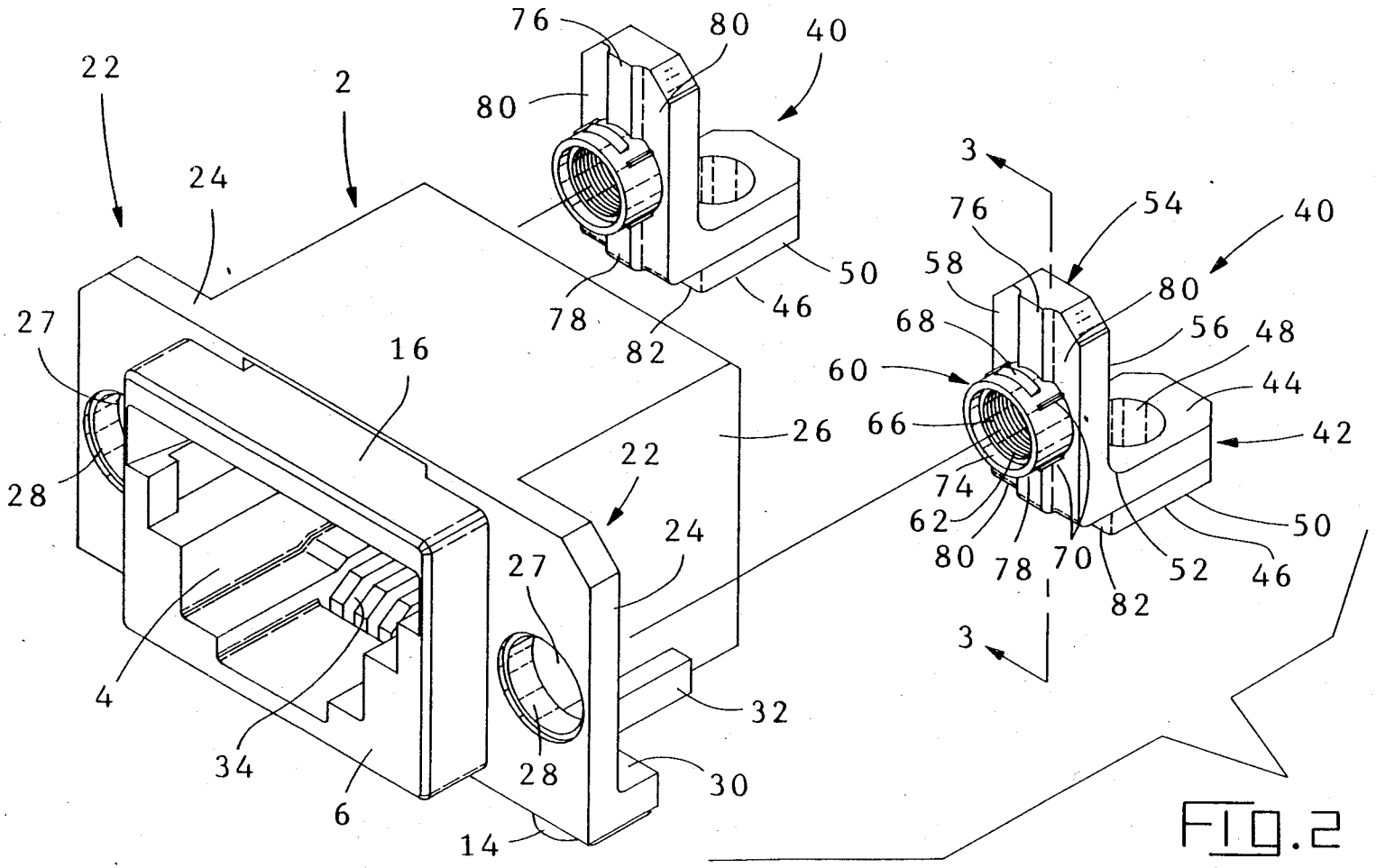
FIG. 2 is an enlarged, exploded, isometric view of the connector housing and a pair of metal retention brackets for assembly thereto.
Figure 4:
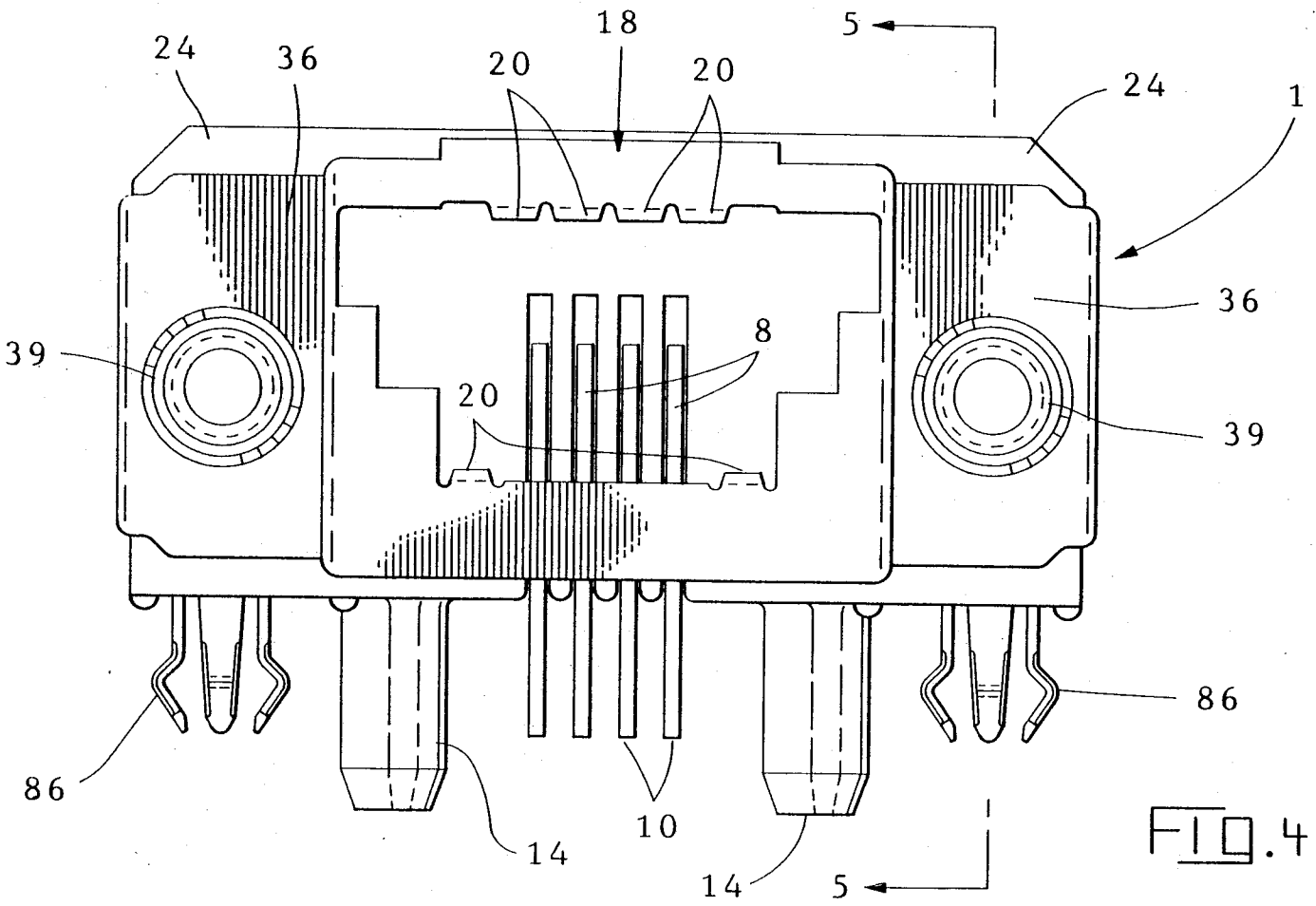
FIG. 4 is a front view of the receptacle connector with the brackets assembled thereto and a metal locking clip assembled to each of said brackets.
Figure 5:
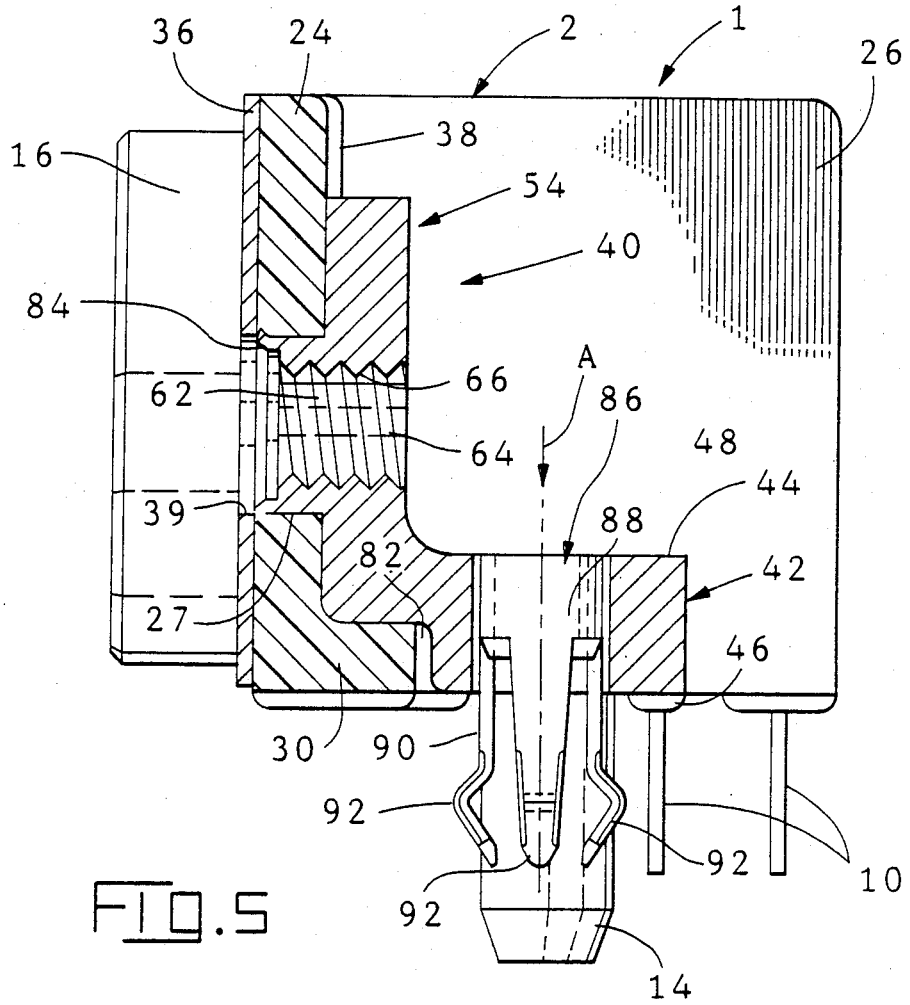
FIG. 5 is a side view, partially in section, taken on the lines 5—5 of FIG. 4.
Figure 10:
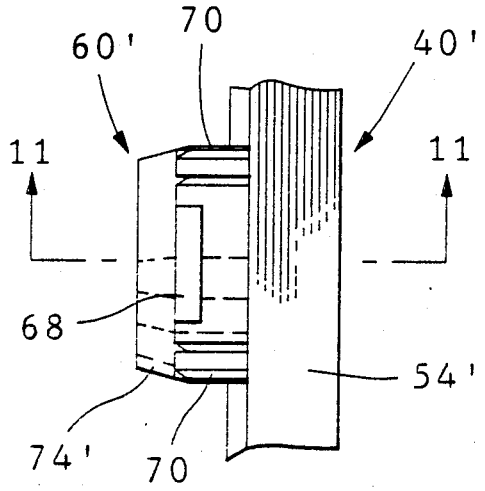
FIG. 10 is a fragmentary side view of the bracket shown in FIG. 9.
Figure 6:
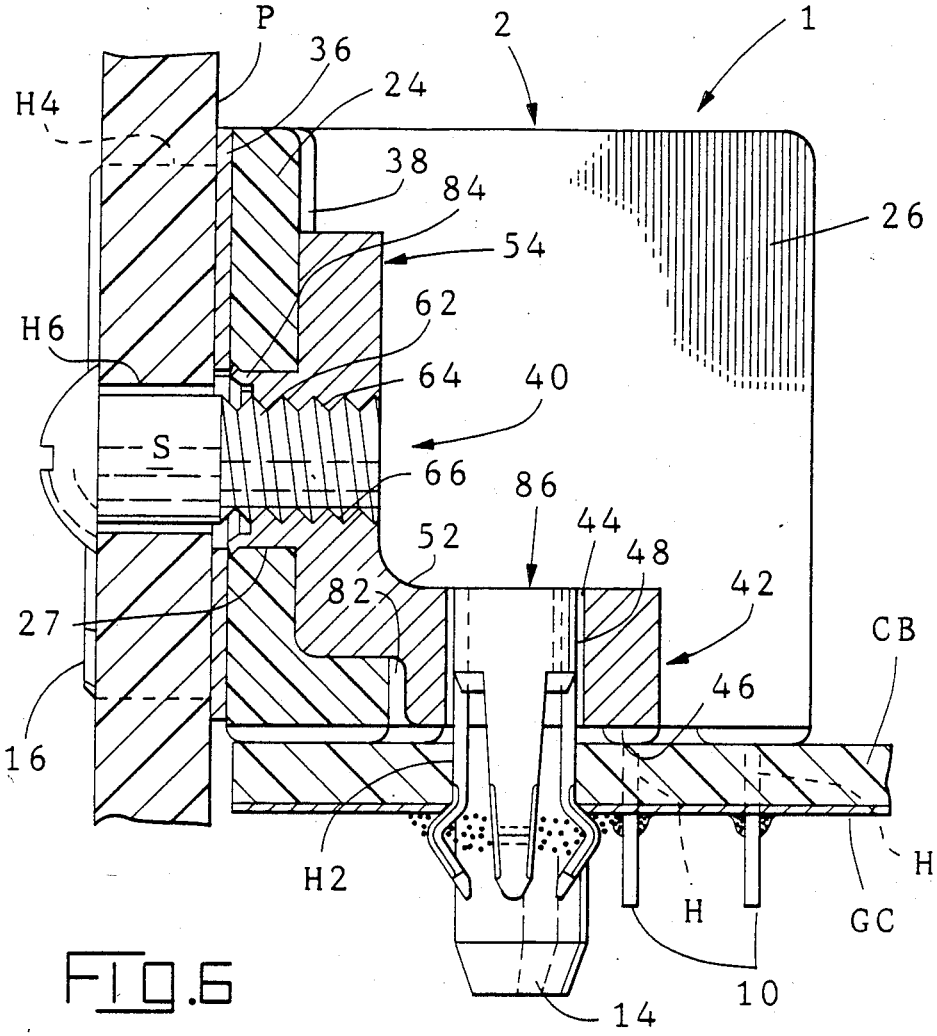
FIG. 6 is a similar view to that of FIG. 5 but showing the connector mounted to a circuit board and to a mounting panel.
Figure 11:
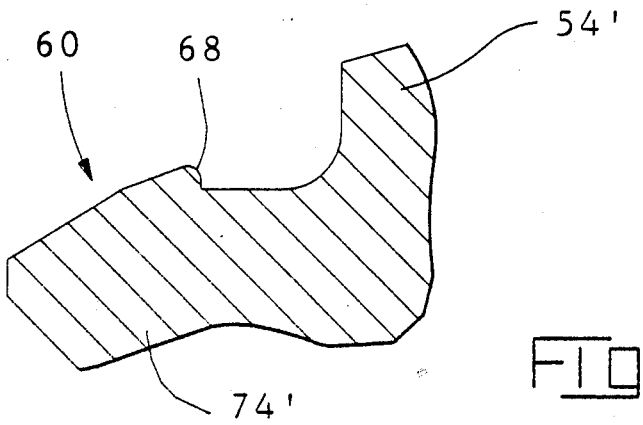
FIG. 11 is an enlarged fragmentary sectional view taken on the lines 11—11 of FIG. 10.
Figure 7:
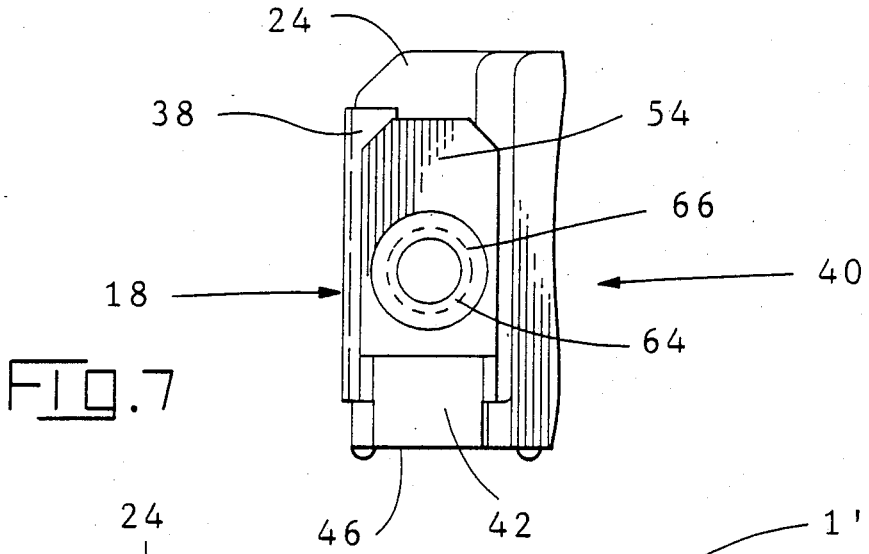
FIG. 7 is a fragmentary rear view of one end of the connector as shown in FIGS. 5 and 6.

Reference will now be made to FIGS. 1 to 7. As best seen in FIGS. 1 and 4, a Shielded Data Link receptacle electrical connector 1 comprises an insulating housing 2, defining a cavity 4, opening into a mating face 6 of the housing 2 for receiving a Shielded Data Link plug electrical connector (not shown). Within the cavity 4 are electrical contacts 8 with contact tails 10 projecting therefrom beneath a bottom wall 12 of the housing 2. The wall 12 is formed with guide posts 14 depending therefrom and extending beyond the end of contact tail 10. A hood 16 which presents the mating face 6 is surrounded by a metal shield 18 with spring fingers 20 which project into the cavity 4 for contact with the shield of the plug connector when it has been mated with the receptacle connector 1. As seen in FIG. 2, there project from opposite end walls 26 of the housing 2, mounting portions 22, each comprising a mounting ear 24 extending at right angles from the respective wall 26 and being formed with a central, circular through opening 27 defined by a wall 28, and a rudimentary bottom flange 30 projecting normally from each ear 24. Each wall 26 is formed with rib 32 level with the adjacent flange 30 and being of the same height. The contacts 8 are received in grooves 34 within the cavity 4. As shown in FIG. 4, portions 36 of the shield 18 extend across the ears 24 and embrace them, in that end parts 38 of the shield portions 36 are wrapped around the lateral edges of the ears 24 as best seen in FIG. 7, so as to overlie their rear faces. The shield portions 36 are formed with openings 29 each aligned with a respective opening 27. Shielded Data Link connectors are described in detail, in U.S. Pat. Nos. 4,457,575, 4,458,973 and 4,572,602, referred to above, all of which are incorporated herein by reference.

There are provided for assembly to the housing 2, two identical one-piece, metal insert brackets 40 cast for example from a zinc alloy, as best seen in FIG. 2. Each bracket 40 comprises a base plate 42 having a top face 44 and a bottom face 46, the base plate 42 defining a central through bore 48 opening into both the faces 44 and 46. Each side of the base plate 42 is undercut to define a guideway 50 opening into each end of the base plate 42 and into its bottom face 46. There upstands from the forward edge 52 of the base plate 42, a flange 54 projecting above the face 44 at right angles thereto. The flange 54 has a rear side 56 adjacent to the top face 44 and a forward, shield engaging, side 58 opposite to the rear side 56. There projects from side 58 of the flange 54, normally thereof, a tubular or hollow, circular cross section, shank 60 having a through bore 62 communicating with a through bore 64 in the flange 54, as best seen in FIG. 5, a screw thread 66 extends through the bores 62 and 64. The shank 60 is formed with externally projecting retention means, in the form of first ribs 68 extending circumferentially of the shank 60 and being spaced from one another about its periphery and second ribs 70 extending axially of the shank 60 and also being spaced from one another about its periphery. As best seen in FIG. 3, each rib 68 has a ramp surface 72 which converges forwardly and inwardly of the shank 60. The ribs 70 have similar ramp surfaces at their ends nearest to the free end of the shank 60. The ribs 68 and 70 are formed and distributed in accordance with the teaching of U.S. Pat. No. 4,709,973, mentioned above, and which is incorporated herein by reference. As best seen in FIG. 3, the free end portion 74 of the shank 60 is of reduced cross sectional area so that it can be peened outwardly as described below. The side 58 of the flange 54 is formed with a pair of opposed ribs 76 and 78 disposed on diametrically opposite sides of the shank 60 and extending longitudinally of the flange 54 and at right angles to the faces 44 and 46 of the base plate 42. Each rib 76 and 78 defines a recess 80. The flange 54 overhangs the lower part of the base plate 42 which is of smaller area than the upper part, to define in cooperation with said lower part a forward recess 82.

In order to assemble each bracket 40 to the housing 2, the bracket 40 is moved towards the respective ear 24 so that the rib 32 adjacent thereto is received in the appropriate guideway 50, the bracket 40 is slid further along the rib 32 towards the ear 24 and the shank 60 is cold pressed into the opening 27 of the ear 24, by means of a suitable tool (not shown), so that the bottom flange 30 is received the recess 82 of the bracket 40 as best seen in FIG. 5. By virtue of the arrangement and the configuration of the ribs 68 and 70, the ears 24 are undamaged by the cold pressing operation, as described in U.S. Pat. No. 4,709,973, although the ribs 68 lock the shank 60 in the opening 27 by engagement with its wall 28, the ribs 70 engaging the wall 28 to prevent any rotational movement of the bracket 40 relative to the housing 2. The end portion 74 of the shank 60 is then peened outwardly as indicated at 84 in FIGS. 5 and 6 so that the bracket 40 is fixed to the ear 24 and thus to the housing 2, with absolute security. A resilient locking clip 86, constructed according to the teaching of U.S. patent application Ser. No 164,312 filed on Mar. 4 1988, mentioned above, and which is incorporated herein by reference, is then inserted into the bore 48 of the respective base plate 42 in the direction of the arrow A in FIG. 5. Alternatively, locking clip 86 may be inserted into bore 48 of a bracket 40 thence the subassembly so formed moved toward a respective ear, as described above. Each locking clip 86, which has been stamped and formed from a single piece of sheet metal stock, comprises a resilient and compliant first portion 88 which fits tightly into the bore 48 and a second portion 90 terminating in outwardly bowed contact springs 92 depending below the bottom face 46 of the base plate 42 in the fully inserted position of the clip 86. In the fully inserted position of the locking clip 86, the guide posts 14 or the housing 2 extend below the contact springs 92.

The housing 2, the brackets 40, and the locking clips 86, having been assembled together as described above, a robot (not shown) is employed to place the connector 1 on a circuit board CB (FIG. 6), having ground conductors GC typically on its underside. During the placing operation, the guide posts 14 of the housing 2 enter holes (not shown) in the board CB thereby to guide the contact tails 10 into further holes H in the board CB to extend through signal conductors (not shown) thereon, and to guide the portions 90 of the locking clips 86, through holes H2 in the board CB, so that as shown in FIG. 6, the contact springs 92 of the clips 86 resiliently engage the periphery of holes H2 where the grounding conductors GC on the board CB are typically located. The locking clips 86 serve to retain the connector 1 on the board CB while it is being transferred to a soldering station at which the contact tails 10 and the contact springs 92 are soldered to their respective conductors on the board CB as indicated in FIG. 6.

In order to install the now board mounted connector 1 at its site of use in a computer, for example, the hood 16 inserted through a rectangular hole H4 in a metal panel P, the panel P engaging the shield portions 36 as shown in FIG. 6. Screws 6 (only one of which is shown) are then inserted through further holes H6 in the panel P on each side of the hole H4 and are driven into mesh with the screw threads 62 thereby drawing the flanges 54 of the brackets 40 towards the panel P so that the parts 38 of the shield portions 36 are tightly engaged between floors of the respective recesses 80, and the ears 24. Firm electrical connections are thereby established between the panel P, the shield 18 and the ground conductors GC by way of the brackets 40 and locking clips 86.

Figure 9:
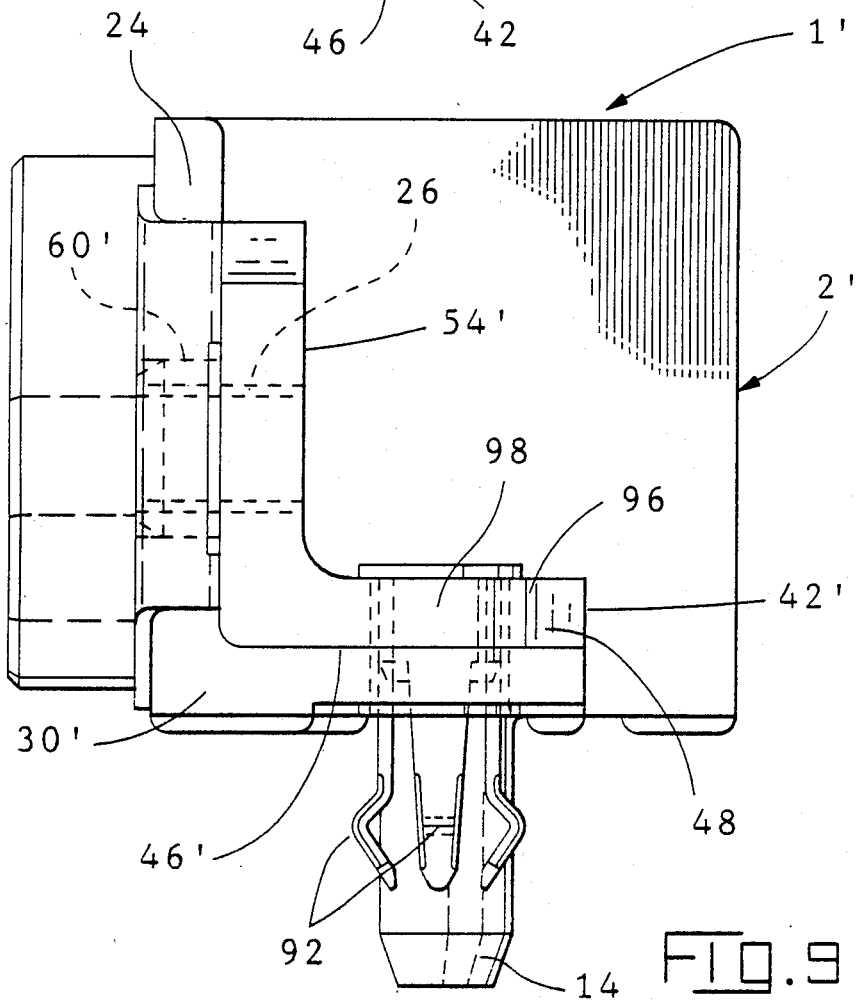
FIG. 9 is a diagrammatic side view of the connector of FIG. 8 showing a retention bracket and a locking clip assembled thereto.
Figure 8:
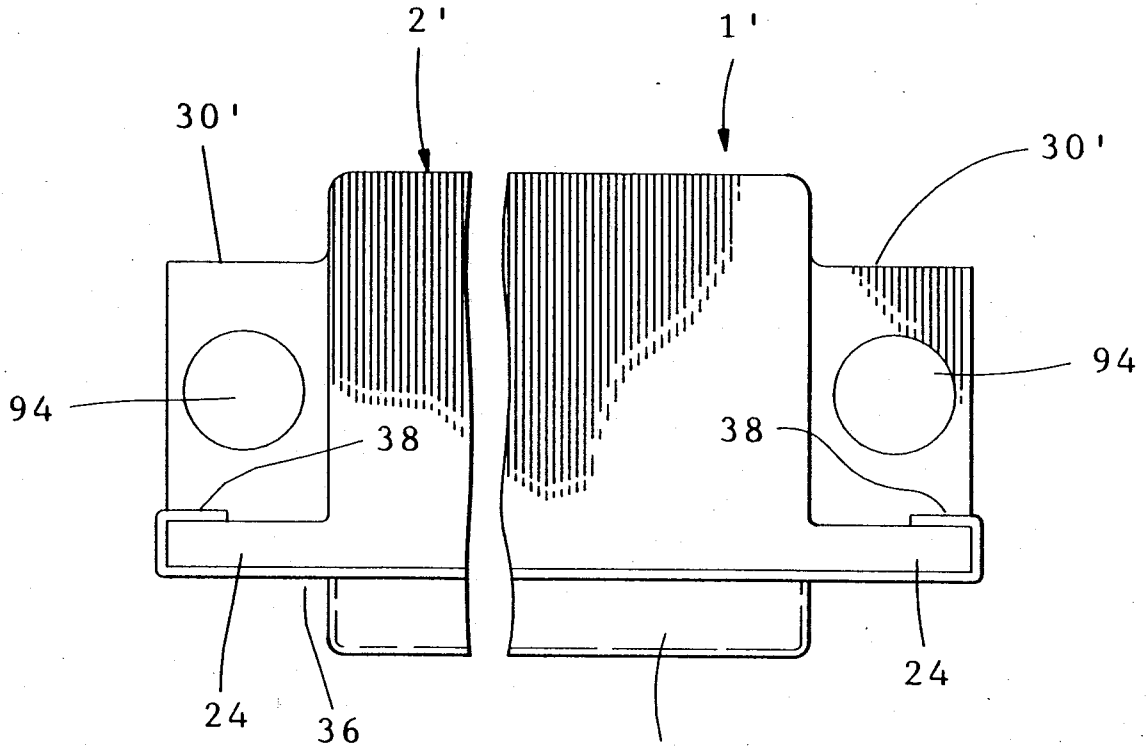
FIG. 8 is a top plan view of a modified form of the connector.

Reference will now be made to FIGS. 8 to 11 which illustrate a modification of the invention as so far described. In these Figures, those parts which are the same as parts already described with reference to FIGS. 1 to 7 bear the same reference numerals. The housing 2' of the connector 1' as shown in FIGS. 8 and 9, differs from the housing 2, in that the rudimentary flanges 30 thereof are replaced by full sized flanges 30, having holes 94 therethrough, the ribs 32 being omitted. The brackets 40' differ from the brackets 40 described above in that their base plates 42' are of constant thickness, the lower surface of the flange 54' being flush with the lower surface 46' of the base plate 42', the ribs 76 and 78 being omitted and the end portion 74' of the shank 60' being externally chamfered to provide a guiding nose, instead of being dimensioned for outward peening. In order to assemble a bracket 40' to the housing 2', the lower face 46' of the base plate 42' is slid along the lower flange 30' of the housing 2' to insert the shank 60' into the opening in the ear 24, and an eyelet 96 may be inserted up through opening 94 of the flange 30', through the bore 48 of the bracket 40' and is riveted thereto as indicated at 98. A locking clip 86 is then inserted down through eyelet 96 so that the contact springs 92 of the locking clip 86 project below the flange 30' as shown in FIG. 9.

I claim:

1. A metal retention bracket for securing a shielded electrical connector housing to a circuit board and to a panel, the bracket comprising:

a base plate having a top face and a bottom face and defining a through bore opening into both of said faces for receiving a board locking metal clip therethrough;

a flange fixedly connected to, and upstanding from, an edge of the base plate and projecting from said top face normally thereof, the flange having a rear side adjacent to said top face and a forward shield engaging side opposite to said rear side;

a hollow, internally screw threaded, shank fixedly connected to the forward side of the flange and projecting normally thereof above said top face of the base plate; and a plurality of spaced retention means projecting externally from said shank and being distributed about the periphery thereof for retaining said shank in an opening in a mounting portion of said housing.

2. A bracket as claimed in claim 1, wherein the flange overhangs the base plate to define a forward recess for receiving a ledge on said mounting portion.

3. A bracket as claimed in claim 2, wherein the base plate defines a lateral guideway extending at right angles to said recess and opening into opposite ends of the base plate and into said bottom face thereof to receive a rib on said housing.

4. A bracket as claimed in claim 1, wherein the forward face of the flange is formed with a central longitudinal rib on each of two diametrically opposite sides of the shank, said ribs extending at right angles to the top and bottom surfaces of the base plate, and defining recesses on either side thereof.

5. A bracket as claimed in claim 1, wherein said shank has a free end portion of reduced cross sectional area for outward peening to fix the shank in said opening.

6. A one-piece metal retention bracket for use in securing an electrical connector housing having a mounting portion embraced by a shield on the housing and having an opening therethrough, to a panel and to a circuit board having a ground conductor thereon, to connect the shield to the ground conductor, the metal bracket comprising:

a base plate having a top face and a bottom face and defining a through bore opening into both of said faces for receiving therethrough a metal clip for locking said housing to said board to connect said bracket to the ground conductor;

a flange upstanding from an edge of the base plate and projecting from the top face thereof, the flange having a rear side adjacent to the top face and a forward side opposite to said rear side, for engaging said shield;

a tubular shank, having an internal through screw thread for meshing with a screw for securing said housing to said panel, the shank projecting from the forward side of the flange; and external retention ribs means on said shank for securing it in said opening against both axial and rotational movement with respect to said mounting portion.

7. A bracket as claimed in claim 6, comprising guide means for sliding engagement with complementary guide means defined by said mounting portion.

8. A bracket as claimed in claim 6, wherein said forward side of the flange defines a recess for receiving a portion of said shield.

9. A bracket as claimed in claim 6, wherein a free end portion of said shank is deformable to secure said shank to said mounting portion.

10. An electrical connector assembly comprising in combination:

a circuit board having a ground conductor thereon and a hole therethrough, the hole extending proximate the ground conductor;

an electrical connector mounted on the circuit board and comprising an insulating housing having a mounting ear projecting therefrom and upstanding from the circuit board, the mounting ear being formed with an opening therethrough;

a metal shield on said housing; embracing said mounting ear;

a one piece cast metal bracket comprising a base having a through bore, a flange upstanding from the base, and a tubular shank projecting from the flange and having an internal screw thread therethrough, the flange engaging a portion of the shield on said mounting ear, and the shank being fixedly secured in the opening in the mounting ear; and a resilient metal locking clip engaged in said bore in the base of the bracket and in the hole in said circuit board and having contact spring means engaged with said grounding conductor.

11. An electrical connector assembly as recited in claim 10, further comprising a mounting panel, and a screw meshing with the screw thread in said shank and securing said panel to said housing and drawing said flange against said shield portion.

12. An electrical connector assembly as recited in claim 10, wherein a leading end portion of said shank is peened outwardly to secure said shank in said opening in the mounting ear.

13. An electrical connector assembly as recited in claim 10, wherein a ledge projects from said mounting ear towards said bracket, said flange and said base cooperating to define a recess for receiving said ledge.

14. An electrical connector assembly as recited in claim 10, wherein a lower flange projecting from said mounting ear extends between said base and said circuit board, an eyelet riveted to said base extending through said bore and said lower flange and receiving said locking clip.

15. An electrical connector for mounting on a circuit board having a hole therein and a ground conductor thereon, the ground conductor extending proximate the hole, said connector comprising:

an insulative housing having a mounting ear projecting therefrom and adapted to upstand from the circuit board, the mounting ear being formed with an opening therethrough;

a metal shield on said housing engaging said mounting ear; and a one piece cast metal bracket comprising a base having a through bore, a flange upstanding from the base and a tubular shank projecting from the flange and having an internal screw thread therethrough, the flange engaging a portion of the shield on said mounting ear, and the shank being fixedly secured in the opening in the mounting ear.

16. An electrical connector as recited in claim 15, further comprising a resilient metal locking clip engaged in said bore in the base of the bracket, said locking clip having contact spring means adapted to be received in the hole in the circuit board, whereby the contact spring means may be soldered to the ground conductor on the circuit board.

17. An electrical connector as recited in claim 15, wherein a leading end portion of said shank is peened outwardly to secure said shank in said opening in the mounting ear.

18. An electrical connector as recited in claim 15, wherein a ledge projects from said mounting ear towards said bracket, said flange and said base cooperating to define a recess for receiving said ledge.

19. An electrical connector as recited in claim 15, further comprising a plurality of spaced retention means projecting externally from said shank and distributed around the periphery thereof for retaining the shake in an opening in a mounting portion of said housing.

20. An electrical connector as recited in claim 15, further comprising a rib on a shield engaging face of said flange, said rib defining a recess on a side thereof.

* * * * *